US006419232B1

(12) United States Patent
Sturdevant, II

(10) Patent No.: US 6,419,232 B1
(45) Date of Patent: Jul. 16, 2002

(54) QUESTION AND ANSWER BOARD GAME USING RECORDED MEDIA

(75) Inventor: Thomas L. Sturdevant, II, Nashville, TN (US)

(73) Assignee: Grand Isle Games, Inc., Nashville, TN (US)

( * ) Notice: Subject to any disclaimer, the term of this patent is extended or adjusted under 35 U.S.C. 154(b) by 0 days.

(21) Appl. No.: 09/752,478

(22) Filed: Jan. 2, 2001

Related U.S. Application Data

(60) Provisional application No. 60/240,133, filed on Oct. 16, 2000.

(51) Int. Cl.[7] ..... A63F 9/18
(52) U.S. Cl. ..... 273/430; 273/242; 273/432
(58) Field of Search ..... 273/292, 242, 273/302, 308, 429, 430, 431, 432

(56) References Cited

U.S. PATENT DOCUMENTS 4,662,635 A 5/1987 Enokian ..... 273/94
4,840,382 A 6/1989 Rubin ..... 273/237
5,106,097 A * 4/1992 Levine
5,121,928 A * 6/1992 Salerno-Sonneberg
5,280,914 A * 1/1994 Selby et al.
5,393,071 A 2/1995 Best ..... 273/434
5,393,072 A 2/1995 Best ..... 273/434
5,472,207 A * 12/1995 Sullivan
5,702,305 A 12/1997 Norman et al ..... 463/42
6,017,035 A 1/2000 Glasser et al. ..... 273/308
6,145,839 A 11/2000 Katsion et al. ..... 273/308
6,279,909 B1 * 8/2001 Alexander, II et al.

* cited by examiner

*Primary Examiner*—William M. Pierce
(74) *Attorney, Agent, or Firm*—Waddey & Patterson; I. C. Waddey, Jr.

(57) ABSTRACT

A movie game and method for playing the game is provided including a game board and a plurality of game pieces for representing each player's position on the game board. The game is played by at least two players. All of the players watch a segment of a prerecorded video, such as a movie video. A question based on the played portion of the prerecorded video is posed by one player who assumes the role of Question Maker. The Question Maker forms an answer to his question but does not reveal it yet. Then, each of the other players formulates an answer to the question and writes it down. The Question Maker reveals his answer and then the players take turns revealing their answers and comparing them with the Question Maker's answer. Each of the other players whose answer generally matches that of the Question Maker's answer is rewarded and has an opportunity to role a die and move his corresponding game piece around the game board in an effort to collect a predetermined amount and type of tokens. The process is then repeated with a different player assuming the role of Question Maker.

32 Claims, 4 Drawing Sheets

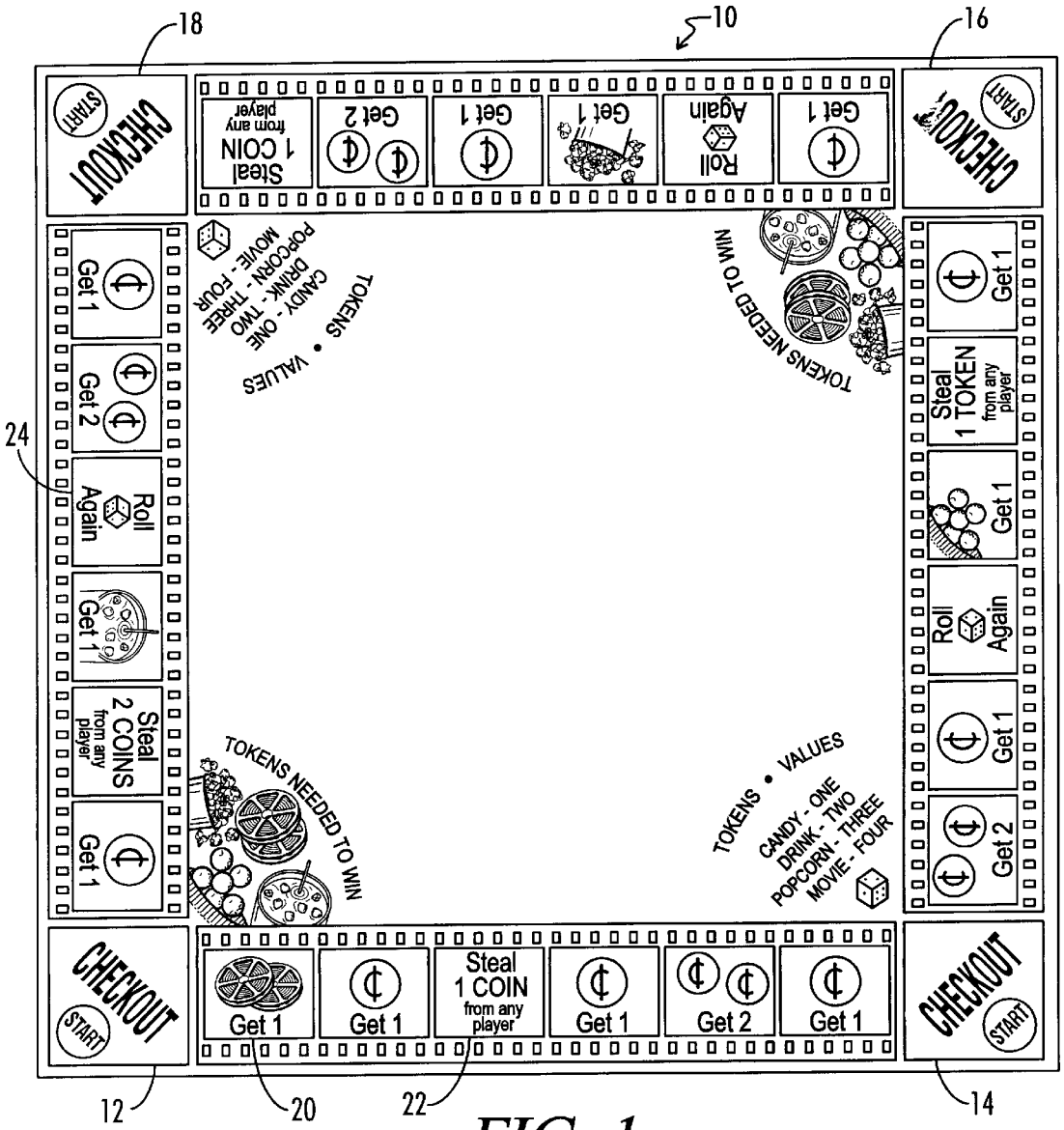
FIG. 1
FIG. 2
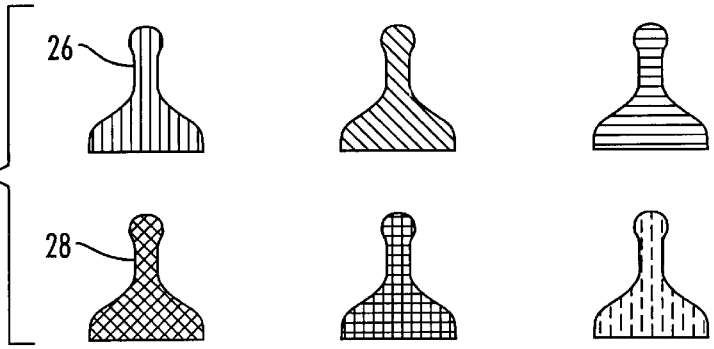

QUESTION AND ANSWER BOARD GAME USING RECORDED MEDIA

This application claims the benefit of abandoned provisional U.S. Patent Application Ser. No. 60/240,133 filed on Oct. 1, 2000 entitled, "Movie Game."

BACKGROUND OF THE INVENTION

The present invention relates generally to games and/or puzzles that in order to be played successfully depend on a player's memory and speed so as to correctly answer questions generated by other players.

Many commercially packaged games available today comprise a game board, multiple game pieces and a series of cards with questions on them, which questions have been prepared in advance by the game designer. A player selects a card from the deck and asks the question on the card to the other players. If a player answers the question correctly, then he or she is allowed to take a turn and advance his or her game piece around the game board. If the player does not answer the question correctly, then that player may, for example, lose a turn.

Other games are known that require the game players to generate their own questions. For example, one game, sometimes referred to as the dictionary game, requires that one player review a dictionary, select a word from it, and announce the selected word to the other players. Then, the other players prepare a written definition for that word. After the allotted amount of time has passed, the players forward their written definitions to one player, who then reads all of the definitions aloud. Then, each player votes for the definition that he or she believes is the correct definition. The player who wrote the definition receiving the most votes scores a predetermined number of points.

Additional games are disclosed in various U.S. patents. For example, U.S. Pat. No. 4,662,635, issued to Enokian on May 5, 1987, involves the display of a play from a live sports event through the use of a video tape, video machine and television. An electronic control console responds to numbers that are selected by the players to determine the play that is then played over the video machine. Once the play occurs, the player advances in the game according to the results of the play. Players take turns until one player ultimately wins the sports game that is being displayed over the video. For example, if the game is a football game, when a player selects a play and his team advances the ball, the ball will be advanced on the game board until such time as the player scores a touchdown. The game is set with time limits and the winner will be the person who has the highest score at the end of the time limit. This patent fails to teach the use of an interactive game that is based on a participant's observation of a played portion of a video tape, wherein the player answers a question based on the played portion.

Additionally, U.S. Pat. No. 4,840,382 to Rubin is directed to an electronic card reader and financial asset game. The game employs a computer that reads cards that are inserted into the computer to control the activities that the players perform on a separate game board. The Rubin patent fails to disclose, however, an interactive game that is based on a participant's observation of a played portion of a video tape, wherein the player answers a question based on the played portion.

Two patents, U.S. Pat. Nos. 5,393,071 and 5,393,072, are both directed to a talking video game with cooperative action; however, they do not involve watching a portion of a movie video or asking and answering questions based on that played portion.

U.S. Pat. No. 5,702,305 to Norman et al discloses an interactive electronic game. This game requires a computer to control the interaction between the players. However, it does not involve the observation of a played portion of a movie video and asking and answering questions based on that played portion.

U.S. Pat. No. 6,145,839 to Katsion et al teaches a "movie game" having a plurality of playing cards, wherein each card has a picture of an actor or actress on one side and a list of movies in which the actor or actress has appeared on the opposite side. The players are shown only the actor's or actress' picture and then, during the allotted time, they take turns identifying movies in which the actor or actress has appeared. Then, if a player's answer matches one of the movies listed on the opposite side of the card, the player earns a point.

The American public loves to watch motion pictures. Printed magazines and TV-magazine type shows, although numerous, still do seem to satisfy the public's interest in movies and movie stars. Nonetheless, Applicant is unaware of any conventional games involving the use of both a game board and pre-recorded media, such as a movie videotape, DVD or other digitally-formatted recorded media. Nor do conventional games involve a combination of activities, such as viewing a portion of pre-recorded media and asking questions generated by the players based on the viewed portion of the pre-recorded media.

What is desired, therefore, is a game that utilizes both a game board and pre-recorded media, such as a video cassette, that involves viewing a portion of a video cassette and asking questions generated by the players based on the viewed portion of the video cassette, that is both easy and fun to play, and that is relatively inexpensive to manufacture.

SUMMARY OF THE INVENTION

Accordingly, it is an object of the present invention to provide a game and a method for playing the game, wherein the game utilizes both a game board and pre-recorded media, such as a video cassette.

It is another object of the present invention to provide a game and method for playing the game that involves viewing a portion of a video cassette and asking a question generated by a player based on the viewed portion of the cassette.

It is a further object of the present invention to provide a game and a method for playing the game that is both easy and fun to play.

It is still a further object of the present invention to provide a game that is relatively inexpensive to manufacture.

To overcome the deficiencies of the prior art and to achieve the objects and advantages discussed above, a game kit and method for playing the game is disclosed. The game kit comprises a game board, a plurality of game pieces, a timer, a die, a plurality writing of implements, pads of paper, and a plurality of coins and tokens.

The game board has a plurality of defined spaces around its perimeter. Instructions are written on each of the game board spaces, such as collect a particular type of token. Other instructions may include, for example, "roll again."

After the game board is set up, each player selects a unique and corresponding game piece to represent that player's position on the game board.

One player assumes the role of Producer. The Producer starts and monitors the timer. The Producer also distributes and exchanges tokens and coins to each player based on the instructions on the space on the game board upon which that player's unique and corresponding game piece is stationed.

After the Producer starts the timer, the players play a portion of a pre-recorded media, such as a video tape, until the timer sounds. Then, one of the players, assuming the role of Question Maker, poses a question to the other players based on the viewed portion of the video tape and formulates an answer thereto. Each of the other players formulates an answer to the question and writes it on a sheet of paper. The Question Maker then reveals his answer and the other players compare their answers with the Question Maker's answer. Each of the other players whose answer generally matches that of the Question Maker's answer is rewarded and is allowed to roll at least one die and move his unique and corresponding game piece a number of spaces on the game board equal to the number shown on the die. Then, that player follows the instructions shown on the space on the game board upon which his unique and corresponding game piece lands or is otherwise stationed.

The process is then repeated with a different player assuming the role of Question Maker.

When one player has accumulated a predetermined number and type of tokens, then that player is deemed to be the winner.

BRIEF DESCRIPTION OF THE DRAWINGS

FIG. 1 is a plan view of a game board constructed in accordance with the present invention;

FIG. 2 is a side plan view of a plurality of game pieces that may be moved around the game board shown in FIG. 1;

DESCRIPTION OF THE PREFERRED EMBODIMENTS

Figure 3:
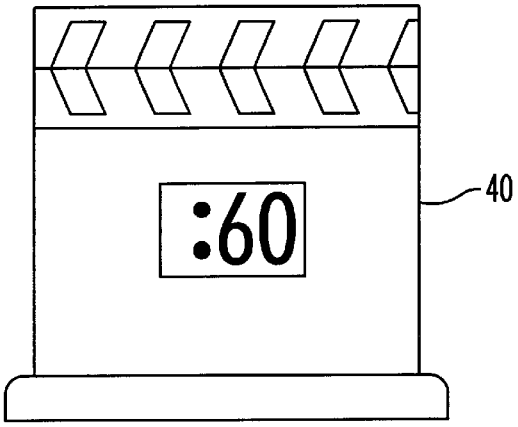
FIG. 3 is a side plan view of a timer.

Referring to the drawings in detail, a game, in accordance with the present invention is shown. It should be noted for the sake of clarity that not all of the components and parts of the game may be shown and/or marked in all the drawings.

As best shown in FIG. 1, the game comprises a game board 10. The game board 10 is generally planar and rectangular in shape, light-weight and easily portable. Game board 10 may, if desired, include a fold-line (not shown) so that the board 10 takes up less space when stored.

A plurality of defined spaces are arranged about the perimeter of game board 10 and have instructions indicated thereon. It should be understood that any suitable number and type of instructions, as desired, may be indicated on the spaces. In the preferred embodiment, four start spaces are located at 12, 14, 16 and 18. Additionally, instructions at space 20 state "get 1 coin." Instructions at space 22 state "steal 1 coin from any player." Similarly, instructions at space 24 state "roll again." Other instructions of the preferred embodiment are shown on game board 10 in FIG. 1.

Each player is assigned a unique and corresponding game piece, such as 26, to represent that player's position on the game board 10. See FIG. 2. Game pieces 26 may be made of any suitable size and shape so long as the game pieces 26 are positionable on the game board 10 and capable of distinguishing one player's position from another's. In the preferred embodiment, game pieces 26 are made of a light-weight plastic of different colors.

Figure 4:
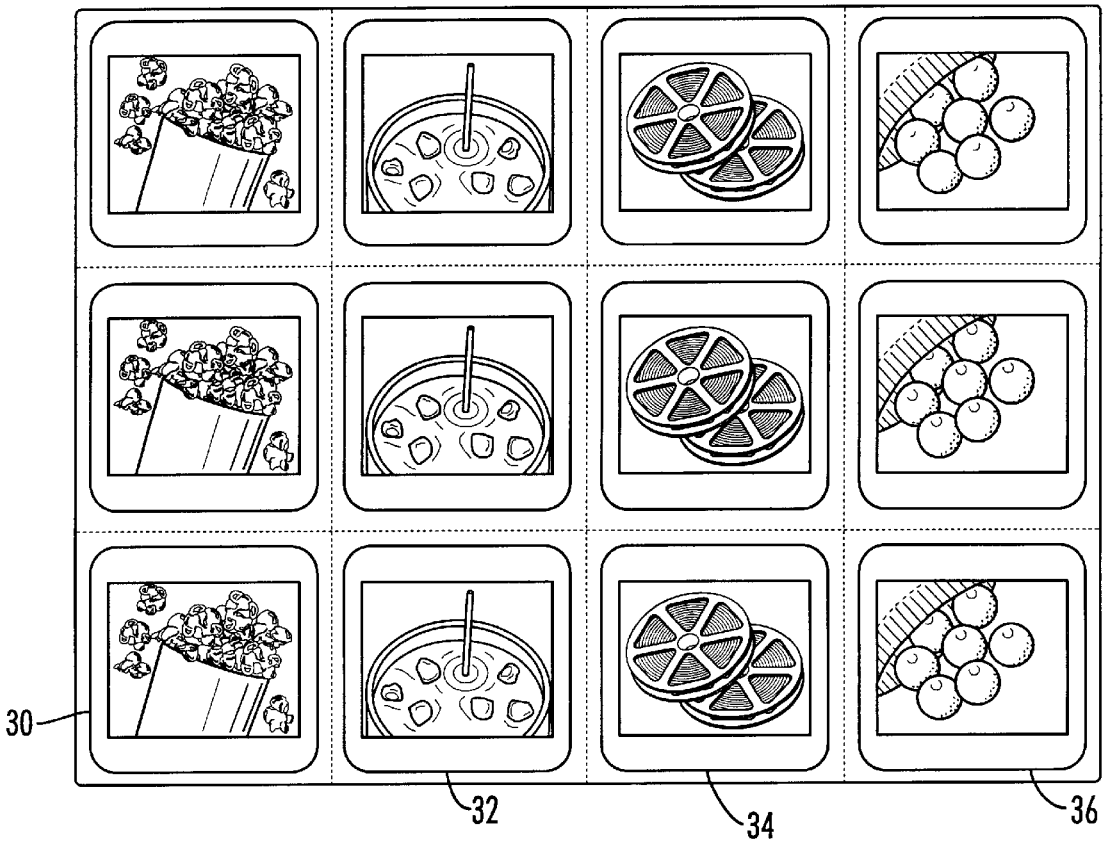
FIG. 4 is a plan view of a plurality of game tokens.

A plurality of different tokens are provided as shown in FIG. 4. It should be understood that any type of token may be used. In the preferred embodiment, the tokens have four different types of identifying and distinguishing indicia. Specifically, the preferred embodiment includes "popcorn" tokens 30, "drink" tokens 32, "movie" tokens 34, and "candy" tokens 36. Any number of tokens may be included in the game kit so long as there is at least one of every different type of token available for every player. The game kit preferably includes six of each type of token, for a total of twenty-four tokens, but any number of tokens may be used.

Figure 5:
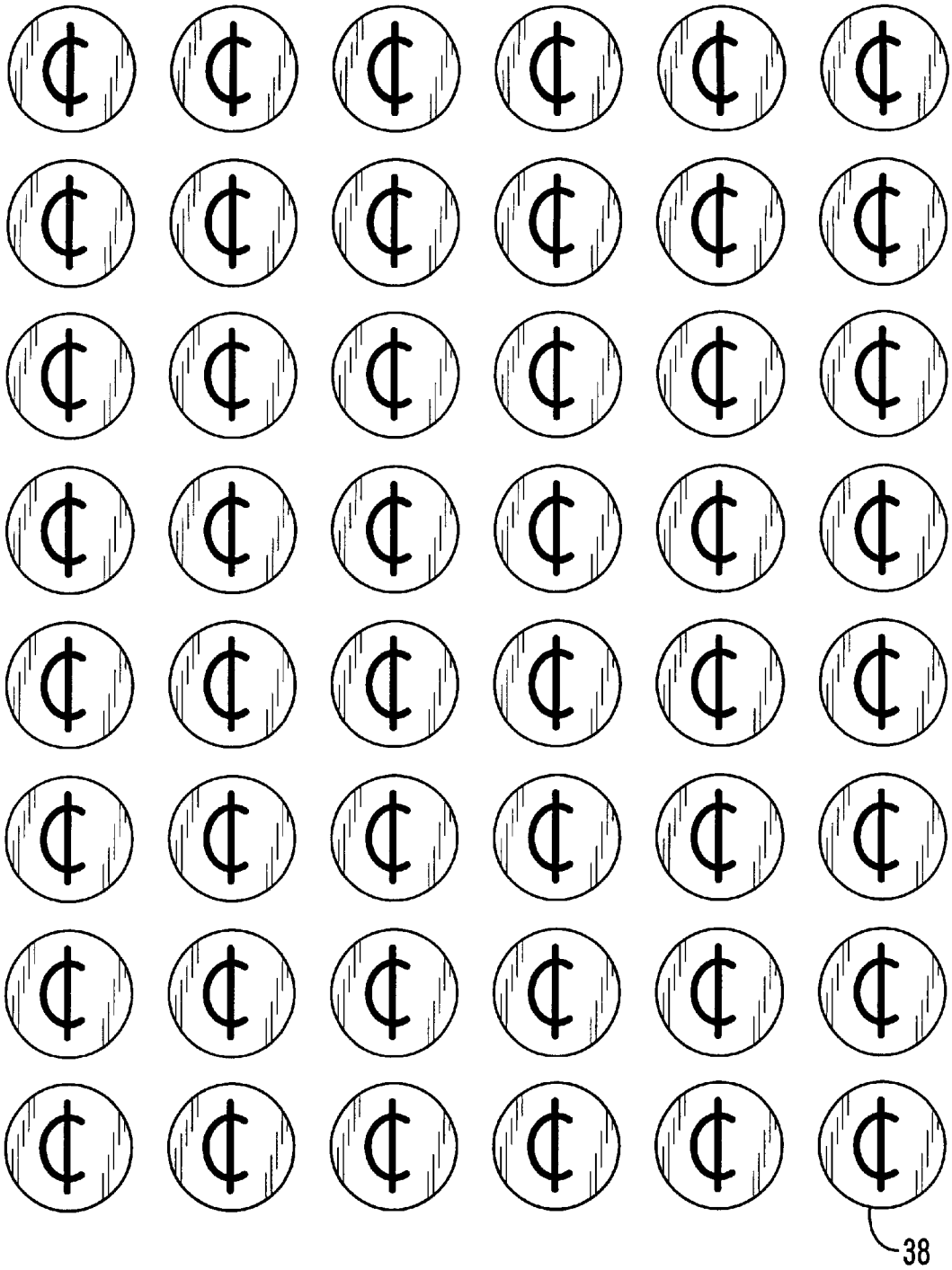
FIG. 5 is a plan view of a plurality of coins for purchasing the tokens shown in FIG. 4.

The game kit further includes a plurality of coins, such as 38. See FIG. 5. It should be understood that any suitable novelty item may be used as a coin so long as it is deemed to have a predetermined purchasing power and assigned a purchase rate so that the players may buy tokens 30, 32, 34, 36 shown in FIG. 4.

A method for playing the game generally comprises the following steps. First, the game board 10 is set up (FIG. 1) and each player is assigned or selects a unique and corresponding game piece 26 (FIG. 2) to represent his or her position on the game board 10. Each player positions his or her game piece 26 on one of the "start" spaces, such as 12 (FIG. 1).

One player assumes the role of Producer and is responsible for starting and monitoring timer 40 (FIG. 3). The Producer is also responsible for distributing and exchanging tokens 30, 32, 34, 36 and coins 38 to each player based on the instructions on the various spaces, such as 20, on the game board 10 upon which that player's unique and corresponding game piece, such as 26, is stationed.

Figure 6:
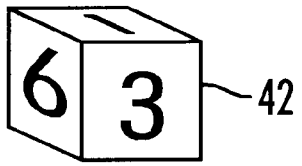
FIG. 6 is an isometric view of a conventional die, sold as part of a game kit.

To begin play, players roll a conventional die 42 (FIG. 6). The player with the highest roll is the Question Maker. The Producer starts timer 40 (FIG. 3).

Then, a portion of a recorded media, such as a video cassette, is played until timer 40 stops. The Question Maker poses a question to the other players based on the played portion of the recorded media. The Question Maker also formulates an answer to his own question, but does not reveal it yet.

Figure 7:
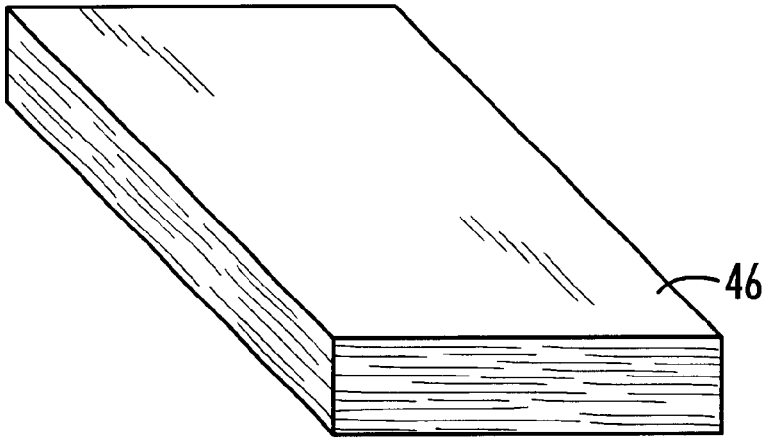
FIG. 7 is an isometric view of a pad of writing paper, sold as part of the game kit.
Figure 8:
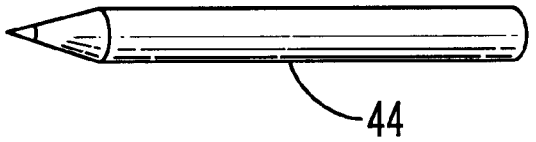
FIG. 8 is a plan view of a conventional pencil, sold as part of the game kit.

Each of the other players formulates an answer to the question and uses pencil 44 (FIG. 8) to write his or her answer on paper 46 (FIG. 7). Then, each of the other players takes a turn revealing his or her written answer to all of the other players. Then, the Question Maker reveals his or her answer. Afterwards, each of the other players compares his or her answer with the Question Maker's answer. Each of the players whose answer generally matches that of the Question Maker's is rewarded and is allowed to take a turn rolling die 42 and moving his or her unique and corresponding game piece 26 (FIG. 2) around game board 10 (FIG. 1) a number of spaces on the game board equal to the number shown on the die 42. Then, that player follows the instructions shown on the space, such as 20, on the game board 10 (FIG. 1) upon which that player's unique and corresponding game piece 26 (FIG. 2) is stationed. The entire process is then repeated with a different player assuming the role of Question Maker.

It should be understood that the rules relating to a player's ability to take a turn and roll a die may vary depending on various factors, such as the competitiveness of the players. In the preferred embodiment, if none of the player's answers are determined to be substantially correct, then no one is allowed to take a turn, not even the Question Maker. Conversely, if all of the other players reveal correct answers, then the Question Maker is forbidden from taking a turn, but all of the other players may take a turn.

In another preferred embodiment, if none of the player's answers are determined to be substantially correct, then the Question Maker is allowed to take a turn and roll die 42.

Players may move forward or backward on game board 10 (FIG. 1) and collect items having a predetermined value, such as coins and tokens. A player is deemed to be the winner when that player has accumulated a predetermined number of tokens, having identifying indicia thereon. In the preferred embodiment, one player is deemed to be the winner when that player has accumulated one "popcorn" token 30, one "drink" token 32, one "movie" token 34 and one "candy" token 3. Therefore, players should move their game piece 26 around game board 10 in a manner that maximizes their ability to obtain the necessary tokens to win.

If at least one of the player believes that the Question Maker's answer is incorrect, he may challenge the answer and is then referred to as the Challenger. Players must have at least one coin (or the equivalent in token wealth as discussed below) to challenge the Question Maker. The Challenger need not know the correct answer to challenge and more than one player may challenge at a time. The video tape should be rewound and the segment in question should be replayed to prove the true answer. If the Question Maker is deemed to be correct, then the Challenger must pay one coin to the Question Maker. If the answer to the question is proven untrue, then the Challenger receives one coin from the Question Maker and all players who answered correctly get to roll the die 40 and move his or her game piece 26 (FIG. 2) on the game board 10 (FIG. 1). If the Question Maker does not have enough coins to pay the Challenger, then the Question Maker may exchange tokens for coins. If the Question Maker does not have enough coins, or equivalent, then the Challenger may collect the coin from the "bank."

The "candy" tokens 36, "drink" tokens 32, "popcorn" tokens 30, and "movie" tokens 34 are sometimes collectively referred to as "Food and Movie" tokens. Players may purchase one "Food and Movie" token each time they land on a "Check-out" corner space, which is shared with the "start" spaces 12, 14, 16, 18. Only one of each kind of "Food and Movie" token may be held in a player's hand at any given time. The cost/exchange rate of the tokens is as follows:

| Item | No. of coins |
|---|---|
| Candy | 1 |
| Drink | 2 |
| Popcorn | 3 |
| Movie | 4 |

If a player lands on a "steal" space on the game board 10 (FIG. 1), that player may steal coins or tokens (the amount and type of which is indicated on the game board 10) from any player or combination of players. If coins are not available, they may not be stolen.

When the game is sold as a kit, it generally comprises the following game components: one game board 10 (FIG. 1); one die 42 (FIG. 6); one timer 40 (FIG. 3); six game pieces, such as 26 (FIG. 2); six pads of paper 46 (FIG. 7); six pencils 44 (FIG. 8); forty-eight coins, such as 38 (FIG. 5); six "candy" tokens 36 (FIG. 4); six "drink" tokens 32; six "popcorn" tokens 30; and six "movie" tokens 34. The game kit also includes instructions for playing the game in the manner discussed above.

It should be understood that the foregoing is illustrative and not limiting and that obvious modifications may be made by those skilled in the art without departing from the spirit or scope of the invention. For example, it would be within the scope and spirit of the present invention to change the rules for advancing around the game board 10, to change the number and type of tokens and coins, and to change any exchange rates. Accordingly, reference should be made primarily to the accompanying claims, rather than the foregoing specification, to determine the scope of the invention.

What is claimed is:

1. A method for playing a game involving at least two players, the method comprising the following steps:

determining a player to assume the role of Question Maker;

playing a portion of a recorded media;

having the Question Maker pose a question and formulate an answer based on the played portion of the recorded media;

having each of the other players formulate an answer to the question;

comparing the answers of the other players with the Question Maker's answer; and rewarding each of the other players whose answer generally matches the Question Maker's answer.

2. The method for playing a game of claim 1 further comprising the step of repeating the steps with a different player assuming the role of Question Maker.

3. The method for playing a game of claim 1 further comprising the steps of:

setting up a game board having a plurality of spaces, each space having instructions thereon; and assigning each player a unique and corresponding game piece to represent that player's position on the game board.

4. The method for playing a game of claim 1 further comprising the steps of allowing each player who reveals an answer that generally matches the answer of the Question Maker to roll at least one die and move his unique and corresponding game piece a number of spaces on the game board equal to the number shown on the die; and then following the instructions shown on the space on the game board upon which that player's unique and corresponding game piece is stationed.

5. The method for playing a game of claim 4, the instructions comprising collecting an item having identifying indicia thereon.

6. The method for playing a game of claim 5, wherein the item is a token or a coin.

7. The method for playing a game of claim 6, further comprising the step of identifying one player as a winner when that player has accumulated a predetermined number of tokens having predetermined identifying indicia.

8. The method for playing a game of claim 7, wherein each token has identifying indicia selected from the group consisting of candy, drink, popcorn or movie.

9. The method for playing a game of claim 8, further comprising the step of identifying one player as a winner when that player has accumulated one token having candy identifying indicia, one token having drink identifying indicia, one token having popcorn identifying indicia and one token having movie identifying indicia.

10. The method for playing a game of claim 6 further comprising the steps of having one player assume the role of Producer; having the Producer start and monitor a timer; and having the Producer distribute and exchange tokens and coins to each player based on the instructions on the space on the game board upon which that player's unique and corresponding game piece is stationed.

11. A method for playing a game involving at least two players comprising the following steps:

setting up a game board having a plurality of spaces, each space having instructions indicated thereon;

having each player select a unique and corresponding game piece to represent that player's position on the game board;

determining a player to assume the role of Question Maker;

viewing at least a portion of a video tape;

having the Question Maker ask a question of the other players and formulate an answer thereto based on the viewed portion of the video tape;

having each of the other players formulate an answer to the question;

revealing each of the other player's answers to the Question Maker's question;

revealing the Question Maker's answer;

comparing each of the other player's answers to the Question Maker's answer;

determining if each of the other player's answers is substantially correct when compared to the Question Maker's answer; and rewarding each player having an answer deemed to be substantially correct with an opportunity to move his unique and corresponding game piece around the game board.

12. The method for playing a game of claim 11, further comprising the step of allowing each player who answered substantially correctly to roll at least one die and move his unique and corresponding game piece on the game board a number of spaces equal to the number shown on the die.

13. The method for playing a game of claim 12 further comprising the step of following the instructions shown on the space on the game board upon which the player's game piece lands.

14. The method for playing a game of claim 13, the instructions comprising collecting an item having identifying indicia thereon.

15. The method for playing a game of claim 14, wherein the item is a token or a coin.

16. The method for playing a game of claim 15 further comprising the step of identifying one player as a winner when that player has accumulated a predetermined number tokens having predetermined identifying indicia.

17. The method for playing a game of claim 16, wherein each token has identifying indicia selected from the group consisting of candy, drink, popcorn or movie.

18. The method for playing a game of claim 15, further comprising the step of identifying one player as a winner when that player has accumulated one token having candy identifying indicia; one token having drink identifying indicia; one token having popcorn identifying indicia; and one token having movie identifying indicia.

19. The method for playing a game of claim 15 further comprising the steps of having one player assume the role of Producer; having the Producer start and monitor a timer; and having the Producer distribute and exchange tokens and coins to each player based on the instructions on the space on the game board upon which that player's unique and corresponding game piece is stationed.

20. The method for playing a game of claim 11 further comprising the step of challenging the Question Maker's answer if at least one of the other players believes that the Question Maker's answer is substantially incorrect.

21. The method for playing a game of claim 11 further comprising the step of forbidding every player from moving his unique and corresponding game piece if none of the player's answers are determined to be substantially correct.

22. The method for playing a game of claim 11 further comprising the step of allowing the Question Maker to move his unique and corresponding game piece on the game board if at least one other player but fewer than all of the other player's answers are determined to be substantially correct.

23. A method for playing a board game involving a plurality of players comprising the following steps:

setting up a game board having a plurality of spaces, each space having instructions thereon for collecting different tokens, and coins for purchasing tokens;

determining a player to assume the role of Question Maker;

viewing at least a portion of a video tape;

having the Question Maker ask a question of each of the other players based on the viewed portion of the video tape and formulate an answer thereto;

having each of the other players formulate an answer to the question;

revealing each of the other player's answers to the Question Maker's question;

revealing the Question Maker's answer;

comparing each of the other player's answers to the Question Maker's answer;

determining if each of the other player's answers is substantially correct when compared to the Question Maker's answer; and allowing each of the other players who answered substantially correctly to roll at least one die and move his unique and corresponding game piece on the game board a number of spaces equal to the number shown on the die and then following the instructions shown on the space on the game board upon which the player's game piece is stationed.

24. The method for playing a board game of claim 23 further comprising the step of identifying one player as a winner when that player has accumulated a predetermined number of tokens.

25. The method for playing a board game of claim 24 further comprising the step of challenging the Question Maker's answer if at least one of the other players believes that the Question Maker's answer is substantially incorrect.

26. A game kit for playing a game by at least two players, the game kit comprising:

a game board having a plurality of spaces and instructions indicated on a plurality of the spaces;

a plurality of unique game pieces for representing each player's position on the game board; and instructions for playing the game, wherein the instructions recite the following steps:

determining a player to assume the role of Question Maker;

playing a portion of a recorded media;

posing a question and formulating an answer based on the played portion of the recorded media by the player who assumes the role of Question Maker;

having each of the other players formulate an answer to the question;

comparing the answers of the other players with the Question Maker's answer;

rewarding each of the other players whose answer generally matches that of the Question Maker's answer; and repeating the aforementioned steps with a different player assuming the role of Question Maker.

27. The game kit of claim 26, wherein the instructions further comprise the steps of:

allowing each player who reveals an answer that generally matches the answer of the Question Maker to roll at least one die and move his unique game piece a number of spaces on the game board equal to the number shown on the die; and then following the instructions shown on the space on the game board upon which that player's unique game piece is stationed.

28. The game kit of claim 27, wherein the game board instructions comprise collecting an item having identifying indicia thereon.

29. The game kit of claim 28, wherein the item is a token or coin.

30. The game kit of claim 29, wherein the game playing instructions further comprise the step of identifying one player as a winner when that player has accumulated a predetermined number of tokens having predetermined identifying indicia.

31. The game kit of claim 30, wherein each token has identifying indicia selected from the group consisting of candy, drink, popcorn, or movie.

32. The game kit of claim 31, wherein the game playing instructions further comprise the step of identifying one player as a winner when that player has accumulated one token having candy identifying indicia, one token having drink identifying indicia, one token having popcorn identifying indicia and one token s having movie identifying indicia.

* * * * *